US011146883B2

(12) United States Patent
Lu et al.

(10) Patent No.: US 11,146,883 B2
(45) Date of Patent: Oct. 12, 2021

(54) EAR-HOOK EARPHONE WITH DETACHABLE MICROPHONE SUPPORT

(71) Applicants: DEXIN ELECTRONIC LTD., Guangdong (CN); DEXIN CORPORATION, New Taipei (TW)

(72) Inventors: Ho-Lung Lu, New Taipei (TW); Shun-Chieh Chang, New Taipei (TW)

(73) Assignees: DEXIN ELECTRONIC LTD., Guangdong (CN); DEXIN CORPORATION, New Taipei (TW)

( * ) Notice: Subject to any disclaimer, the term of this patent is extended or adjusted under 35 U.S.C. 154(b) by 0 days.

(21) Appl. No.: 16/894,892

(22) Filed: Jun. 8, 2020

(65) Prior Publication Data

US 2021/0258673 A1 Aug. 19, 2021

(30) Foreign Application Priority Data

Feb. 17, 2020 (TW) ..... 109201701

(51) Int. Cl.
*H04R 1/10* (2006.01)

(52) U.S. Cl.
CPC ..... *H04R 1/105* (2013.01); *H04R 2201/02* (2013.01); *H04R 2420/07* (2013.01)

(58) Field of Classification Search
CPC ..... H04R 1/105; H04R 1/08; H04R 1/345; H04R 1/083; H04R 1/1066; H04R 1/1008; H04R 1/1016; H04R 1/1058; H04R 2201/02; H04R 2201/107; H04R 2420/07; H04R 25/652; H04R 25/456; H04R 25/65; H04R 25/60; H04R 2225/025; H04R 2225/63; H04R 2225/021; G10D 1/085; G11B 5/00; G11B 2005/0002; A62B 18/08; H04M 1/05
USPC ..... 381/381, 380, 330, 328, 367, 366, 375
See application file for complete search history.

(56) References Cited

U.S. PATENT DOCUMENTS

| | | | | |
|---|---|---|---|---|
| 7,248,902 B2 * | 7/2007 | Chu | H04M 1/6066 | 379/420.01 |
| 2009/0176538 A1 * | 7/2009 | Dunn | H04M 1/6066 | 455/569.1 |
| 2011/0019860 A1 * | 1/2011 | Birch | H04R 1/1033 | 381/375 |
| 2012/0082331 A1 * | 4/2012 | Meosky | H04R 25/607 | 381/323 |

(Continued)

FOREIGN PATENT DOCUMENTS

JP 2008294872 A * 12/2008 ..... H04R 1/10

*Primary Examiner* — Khai N. Nguyen
*Assistant Examiner* — Sabrina Diaz
(74) *Attorney, Agent, or Firm* — Li & Cai Intellectual Property Office

(57) ABSTRACT

An ear-hook earphone with detachable microphone support includes an earphone body, a microphone support and an ear hook. The earphone body includes a housing assembly, a speaker unit, a first connection member and a second connection member, the housing assembly accommodates the speaker unit, the first connection member and the second connection member. The microphone support includes a plug, and the plug is detachably inserted into the first connection member. The ear hook includes a docking end and a flexible hook part connected to the docking end, and the docking end is detachably inserted into the second connection member.

11 Claims, 8 Drawing Sheets

(56) References Cited

U.S. PATENT DOCUMENTS

2017/0195770 A1* 7/2017 Cheney ..... H04R 1/105

* cited by examiner

EAR-HOOK EARPHONE WITH DETACHABLE MICROPHONE SUPPORT

CROSS-REFERENCE TO RELATED PATENT APPLICATION

This application claims the benefit of priority to Taiwan Patent Application No. 109201701, filed on Feb. 17, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an ear-hook earphone with detachable microphone support, and in particular to an ear-hook earphone capable of playing sound, which has a detachable microphone support to receive sound, and a detachable ear hook that can be worn on an ear of a user.

BACKGROUND OF THE DISCLOSURE

An ear hook is added to some conventional wireless earphones to increase firmness and comfort of wearing during exercise. Such wireless earphones can be called ear-hook earphones. The ear hook and a microphone of the conventional ear-hook earphones are typically made from a plastic material. In addition, the conventional wireless earphones require use of the microphone when playing mobile games or making phone calls.

However, the conventional wireless earphones with ear hooks and microphones cannot accommodate users to allow the use of only necessary parts or accessories thereof under different scenarios. For example, when listening to music, the wireless earphones only require an earphone body, and the microphone is unnecessary; and when not exercising, the ear hook of the wireless earphones is unnecessary.

Accordingly, the conventional wireless earphones still lack flexibility in matching accessories to occasion. Therefore, there is still room for improvement.

SUMMARY OF THE DISCLOSURE

The present disclosure aims to solve the technical problems of the conventional technology, the present disclosure provides an ear-hook earphone with detachable microphone support, the ear-hook earphone is not limited to being a music earphone, and can be used in different scenarios such as making phone calls, exercising and mobile gaming.

In addition, the technical problem to be solved in the present disclosure is to provide accessories that are detachable for the earphone, allowing users to match different accessories thereto so as to meet the requirements of different scenarios. Furthermore, an ear hook and a microphone are made to be completely flexible, allowing the users to adjust the ear hook and the microphone according to their ear shape and wearing style to increase firmness and comfort of wearing.

In response to the above technical problems, the present disclosure provides the ear-hook earphone with detachable microphone support includes an earphone body, a microphone support and an ear hook. The earphone body includes a housing assembly, a speaker unit, a first connection member and a second connection member, the housing assembly accommodates the speaker unit, the first connection member and the second connection member. The microphone support includes a plug, and the plug is detachably inserted into the first connection member. The ear hook includes a docking end and a flexible hook part connected to the docking end, and the docking end is detachably inserted into the second connection member.

Therefore, a beneficial effect of the present disclosure is that the present disclosure provides the ear-hook earphone with detachable microphone support, and provides detachable accessories for the earphone, so that users have a flexibility of matching and applying accessories in different scenarios. In addition, the ear hook and the microphone are made to be completely flexible, allowing users to adjust the ear hook and the microphone according to their ear shape and wearing style to increase firmness and comfort of wearing.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
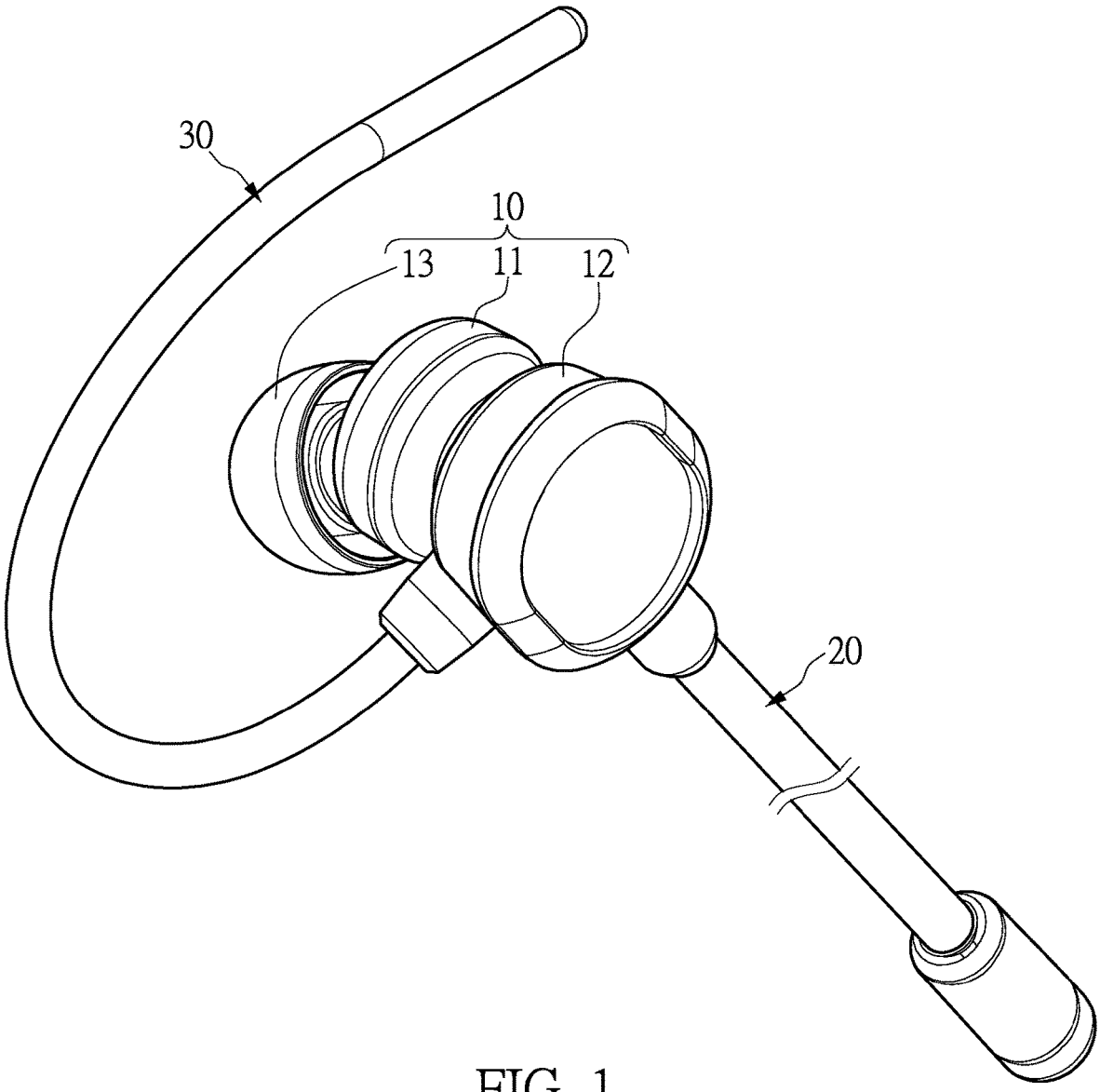
FIG. 1 is a perspective view of an ear-hook earphone with detachable microphone support according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
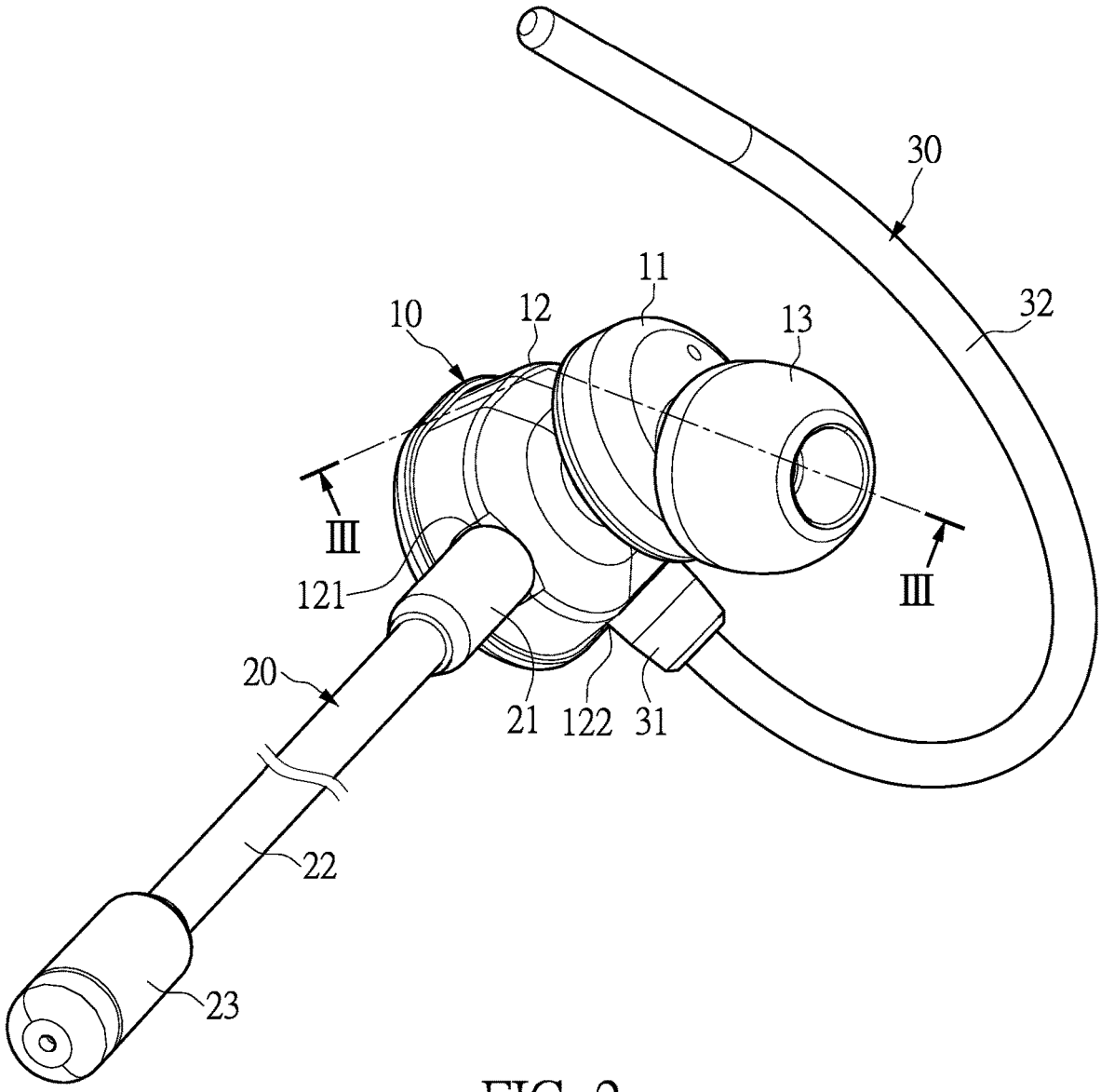
FIG. 2 is another perspective view of the ear-hook earphone with detachable microphone support according to the first embodiment of the present disclosure.
Figure 3:
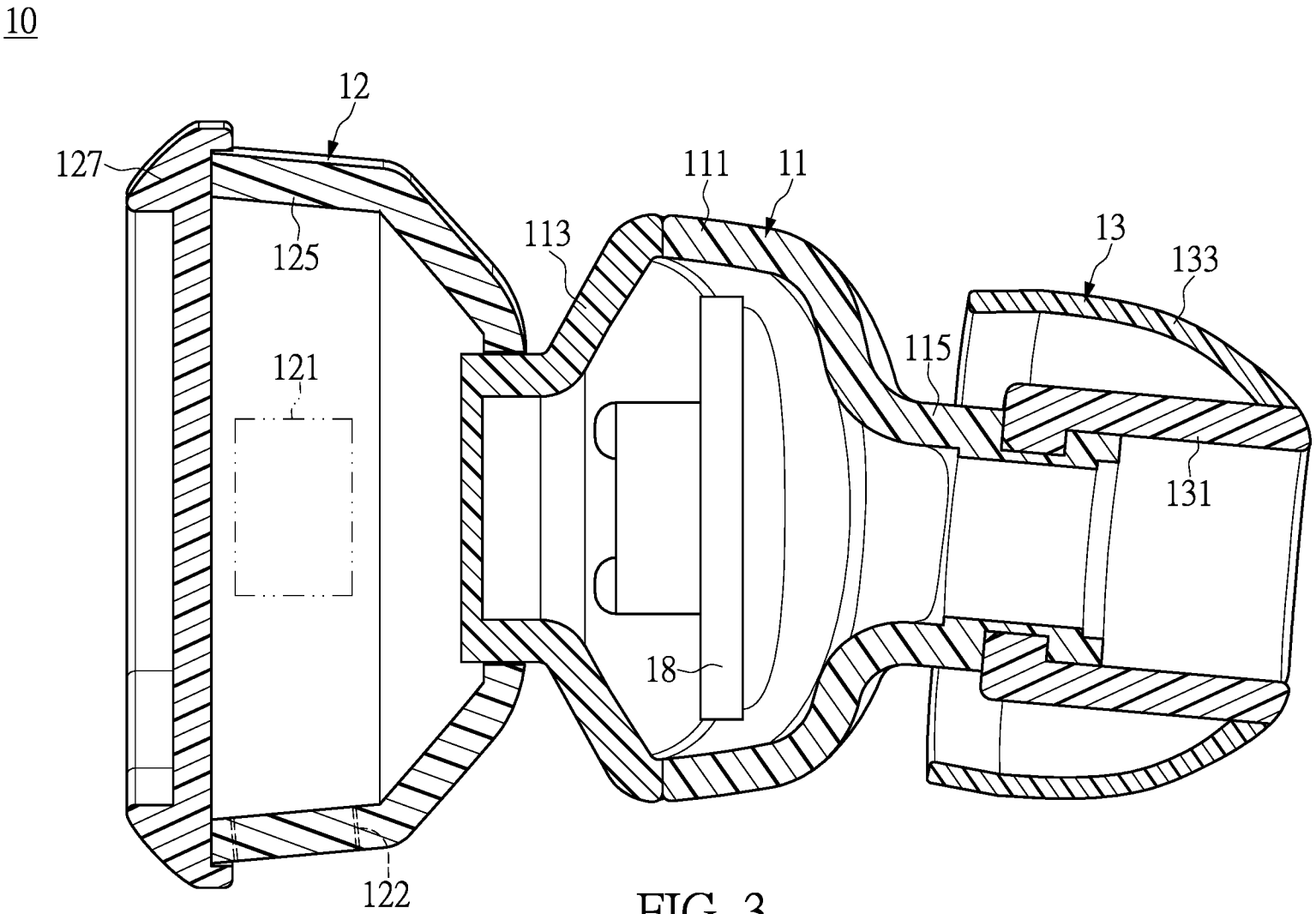
FIG. 3 is a sectional view taking along line III-III in FIG. 2 according to the first embodiment of the present disclosure.

Referring to FIGS. 1 to 3, the present disclosure provides an ear-hook earphone with detachable microphone support, including: an earphone body 10, a microphone support 20 and an ear hook 30. The earphone body includes a housing assembly (11, 12), a speaker unit 18, a first connection member 121 and a second connection member 122. The housing assembly (11, 12) accommodates the speaker unit 18, the first connection member 121 and the second connection member 122. The microphone support 20 includes a plug 21 which is detachably inserted into the first connection member 121. The ear hook 30 includes a docking end 31 which is detachably inserted into the second connection member 122.

The earphone body 10 includes a speaker section 11 and an assembly section 12 connected to an end of the speaker section 11, the speaker unit 18 is accommodated in the speaker section 11, and the assembly section 12 accommodates the first connection member 121 and the second connection member 122.

Figure 4:
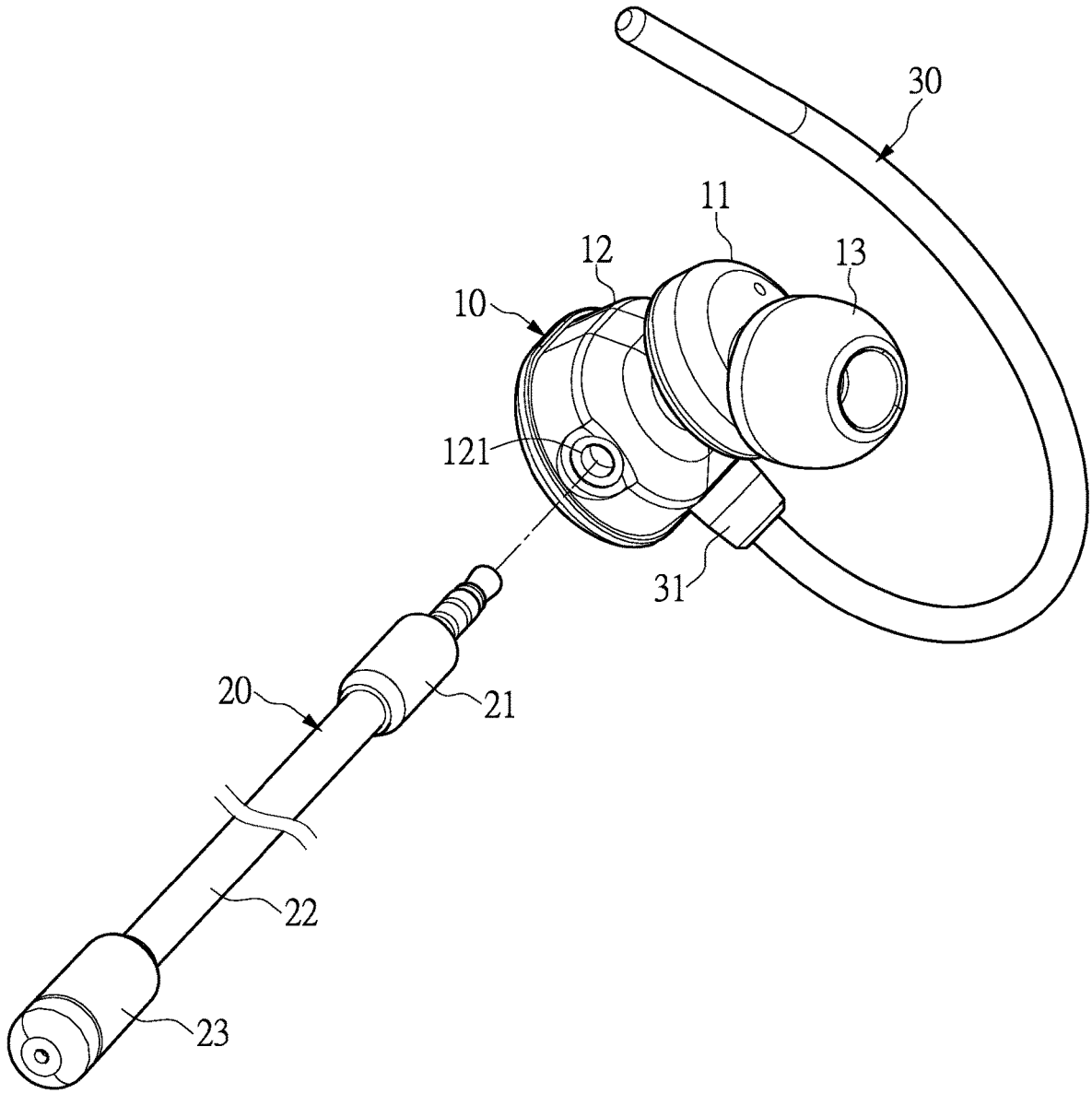
FIG. 4 is a schematic view of removing the microphone support of the ear-hook earphone with detachable microphone support according to the first embodiment of the present disclosure.
Figure 5:
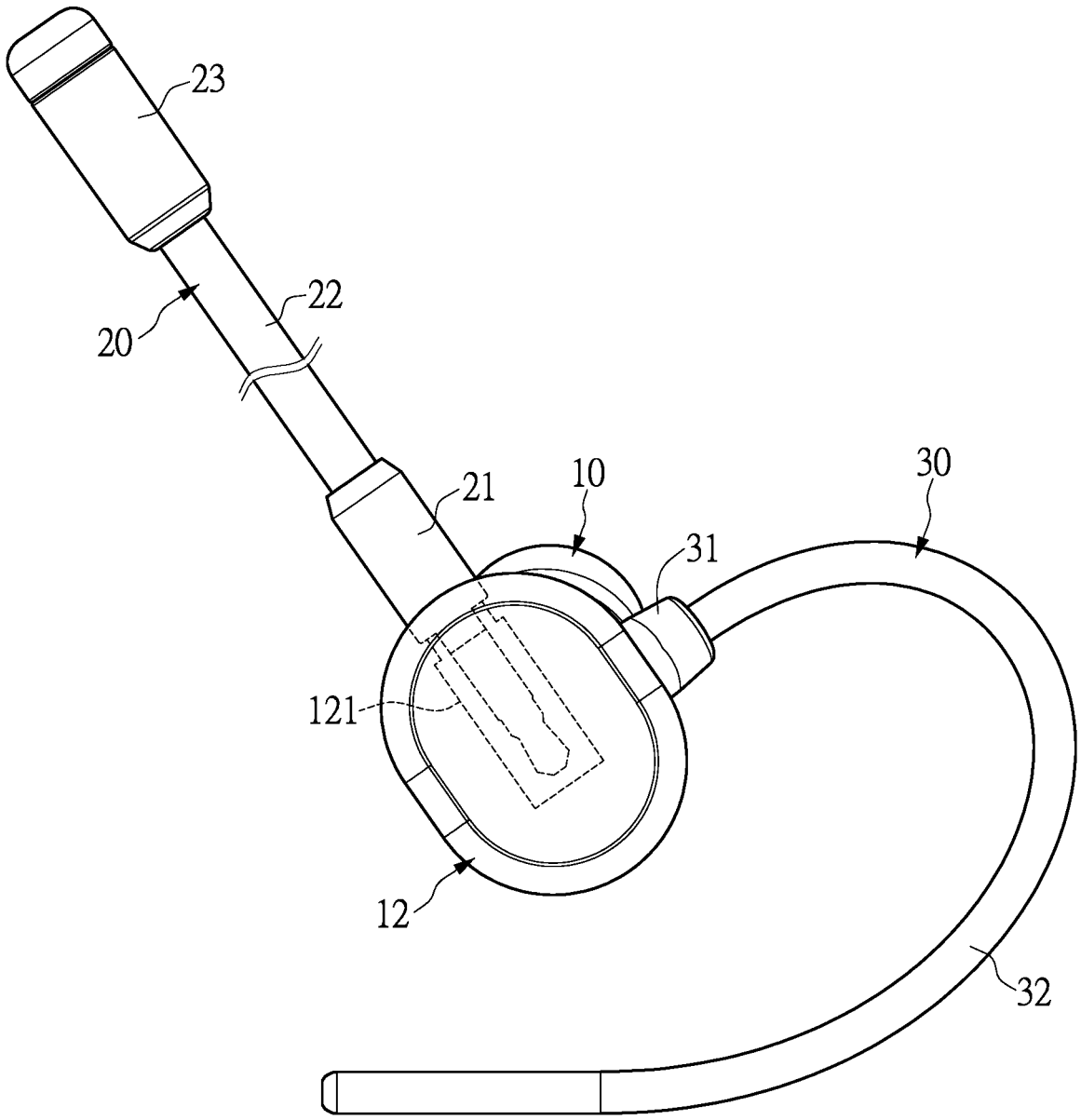
FIG. 5 is a side view of the ear-hook earphone with detachable microphone support according to the first embodiment of the present disclosure.
Figure 6:
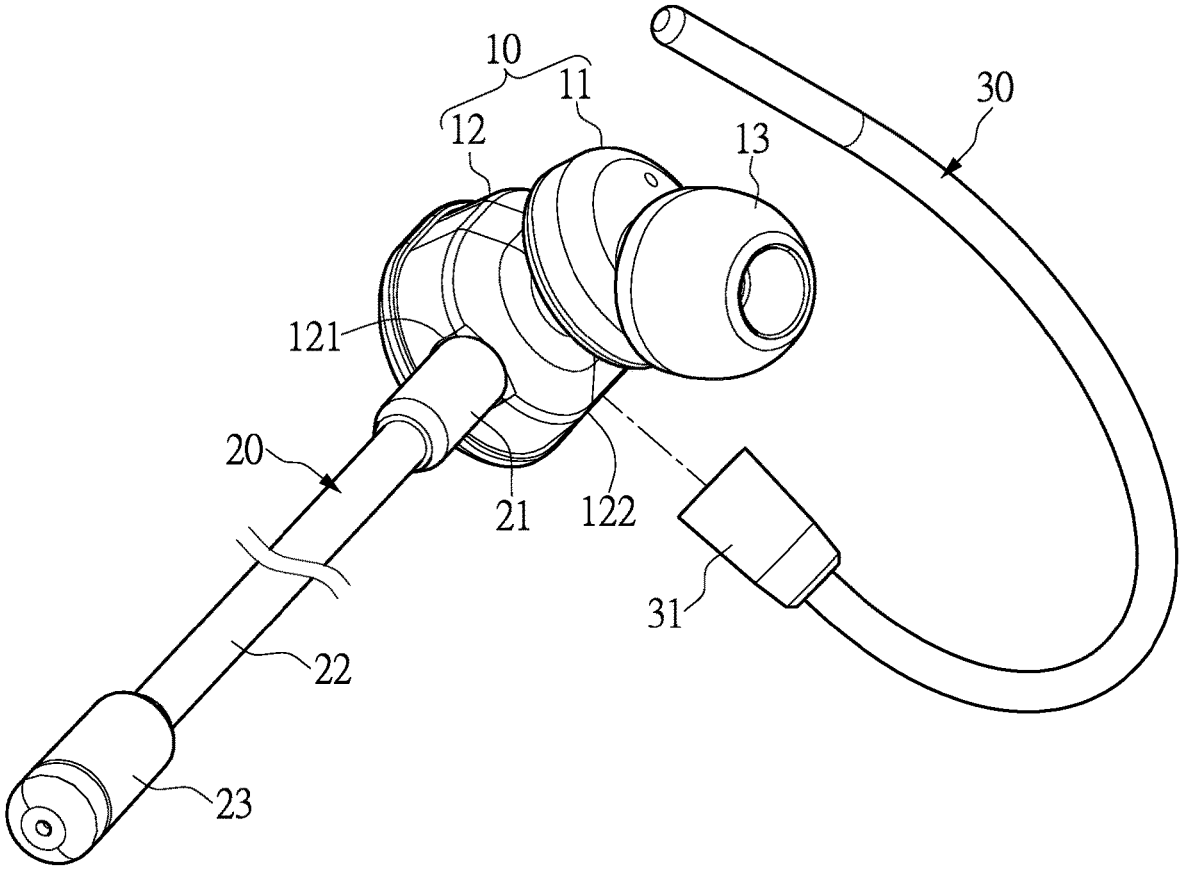
FIG. 6 is a schematic view of removing the ear hook of the ear-hook earphone with detachable microphone support according to the first embodiment of the present disclosure.

Referring to FIGS. 4 to 6, the microphone support 20 further includes a flexible rod body 22 and a microphone 23, the plug 21 is connected to an end of the flexible rod body 22, and the microphone 23 is connected to another end of the flexible rod body 22 and is electrically connected to the plug 21. The ear hook 30 further includes a flexible hook part 32 connected to the docking end 31.

In the present embodiment, the first connection member 121 is an earphone socket, for example, the earphone socket can be an earphone connector (i.e. phone jack), and an aperture thereof can be 2.5 mm or 3.0 mm, but the present disclosure is not limited thereto. An example of the second connection member 122 is a fixing hole corresponding to the docking end 31 of the ear hook 30. The docking end 31 of the present embodiment has an elastic ring which can be tightly fitted into the fixing hole, but the present disclosure is not limited thereto.

Referring to FIG. 3, which is a sectional view taking along line III-III in FIG. 2. In the present embodiment, the speaker section 11 includes a front main casing 111 and a rear main casing 113 connected to the front main casing 111. A front end part 115 of the front main casing 111 is detachably connected to an in-ear eartip 13, the in-ear eartip 13 has a tube part 131 and an eartip part 133, the tube part 131 is connected to the front end part 115, the eartip part 133 is connected to the tube part 131, and the speaker unit 18 is accommodated in the front main casing 111 and is covered by the rear main casing 113.

The assembly section 12 includes a main accommodating part 125 and a cover 127, the main accommodating part 125 is connected to the rear main casing 113, and the cover 127 is covered on the main accommodating part 125.

The speaker section 11 of the present embodiment is substantially disc-shaped, the assembly section 12 is substantially capsule-shaped, a center axis of the speaker section and a center axis of the assembly section are not parallel to each other, and the two center axes form an obtuse angle therebetween, as the line III-III in FIG. 2.

In addition, the present disclosure can be an earphone body of a true wireless Bluetooth® earphone (true wireless stereo, TWS). The true wireless Bluetooth earphone adopts true wireless stereo technology, where a mobile phone can be connected to the earphone body through a Bluetooth network, and the earphone body is wirelessly connected to a secondary earphone, so that a real wireless separation of left and right Bluetooth sound channels can be achieved. The secondary earphone can be only worn with the ear hook 30, and the microphone 23 is not necessary.

Second Embodiment

Figure 7:
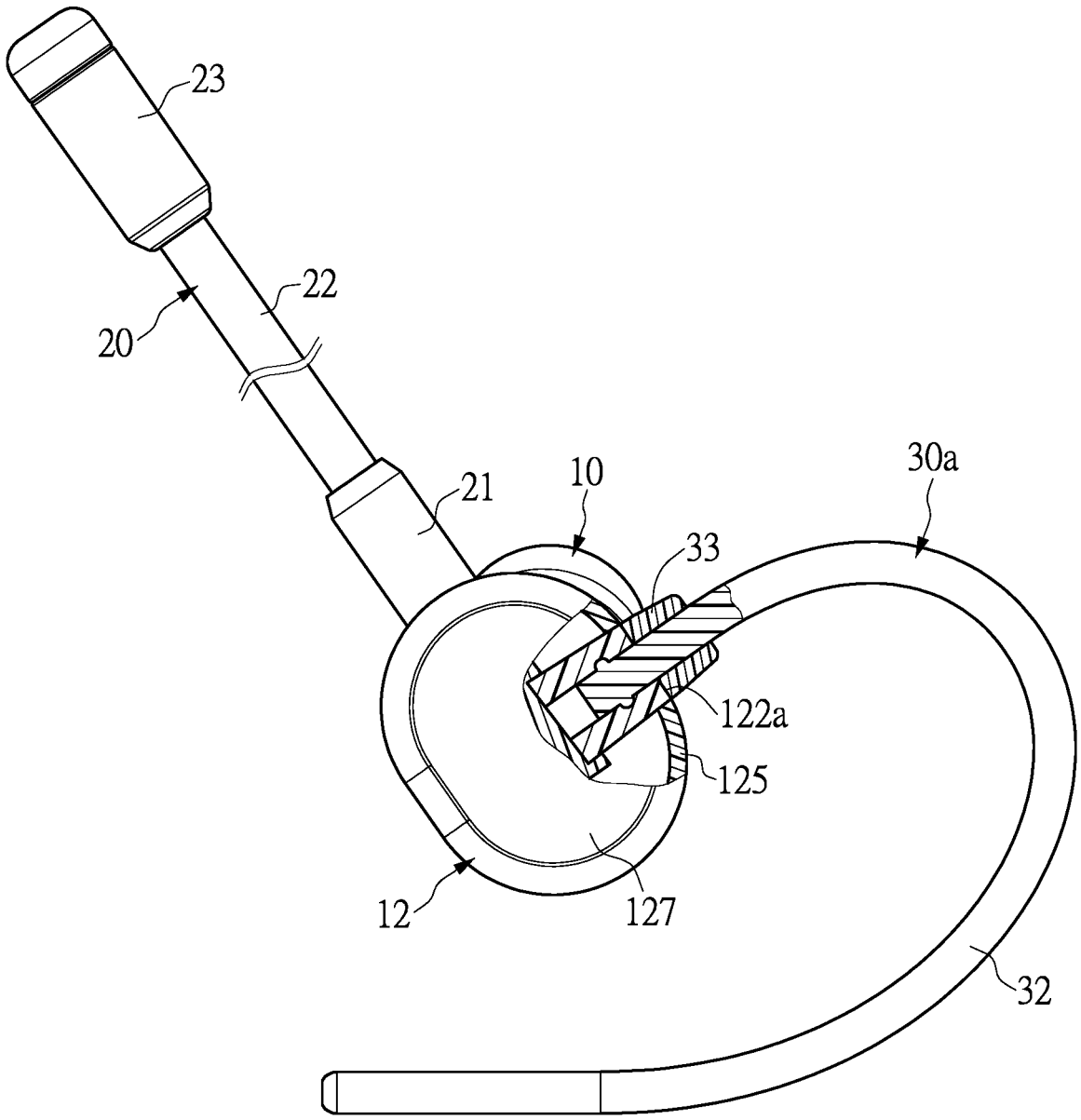
FIG. 7 is a side view of the ear-hook earphone with detachable microphone support according to a second embodiment of the present disclosure.
Figure 8:
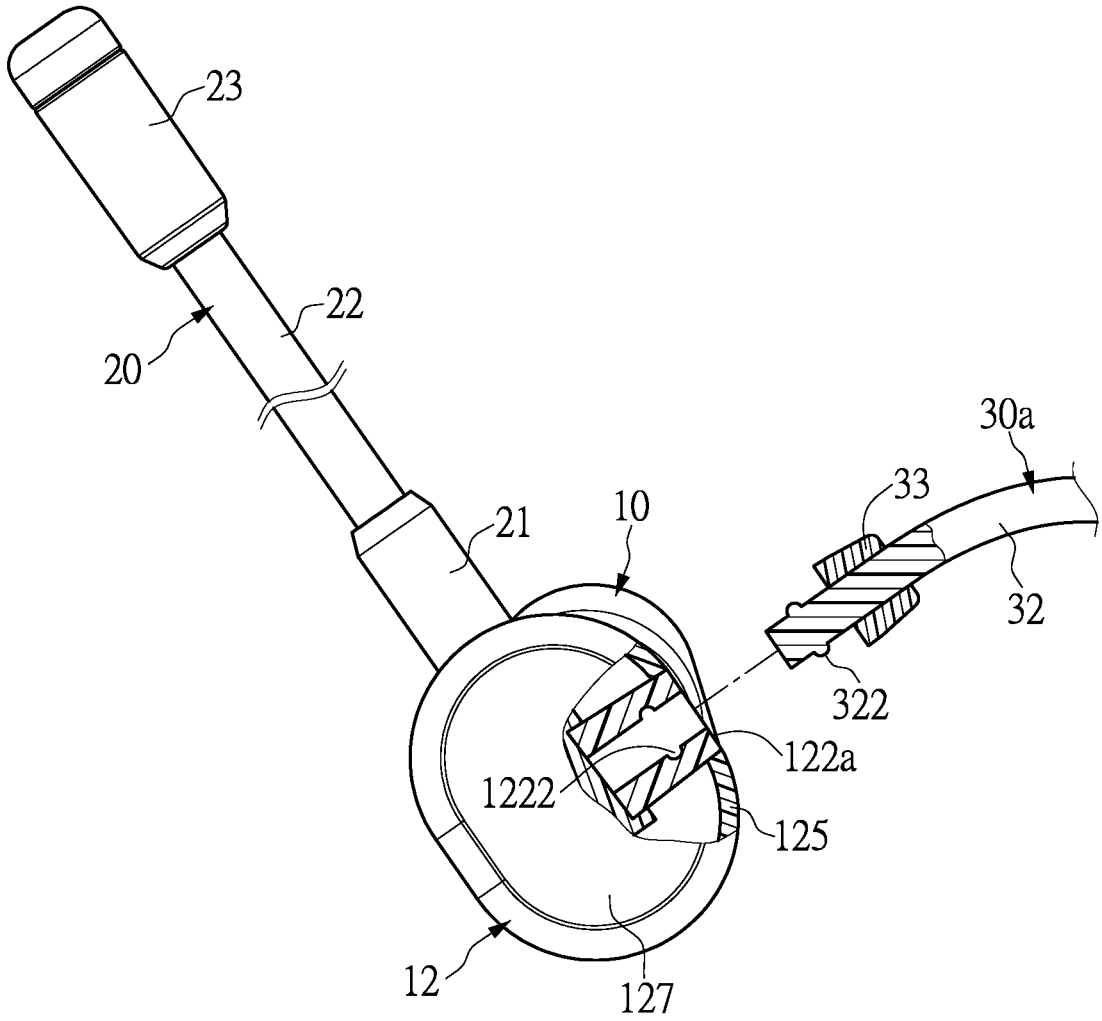
FIG. 8 is a schematic view of removing the ear hook of the ear-hook earphone with detachable microphone support according to the second embodiment of the present disclosure.

Referring to FIGS. 7 and 8, the ear-hook earphone with detachable microphone support of the second embodiment in the present embodiment provides another type of an ear hook 30*a*, and the ear hook 30*a* is detachably fixed to the assembly section 12 through another method. The ear hook 30*a* has an outer ring 33, the flexible hook part 32 passes through the outer ring 33, and a part of the flexible hook part 32 exposed from the outer ring 33 forms a convex part 322. In the present embodiment, the second connection member 122*a* is disc-shaped and forms a slot 1222 inside of the second connection member 122*a*. The part of the flexible hook part 32 exposed from the outer ring 33 inserts into the second connection member 122*a*, and the convex part 322 of the flexible hook part 32 is engaged with the slot 1222 inside of the second connection member 122*a*.

In addition, the part of the flexible hook part 32 exposed from the outer ring 33 of the present embodiment can serve as an electrical connection part, and an inside of the second connection member 122*a* serves as another electrical connection part. Accordingly, the flexible hook part 32 can be electrically connected to the second connection member 122*a* to supply power, or the flexible hook part 32 can be used as an extended antenna to strengthen the transmission and reception of wireless signals. Alternatively, the flexible hook part 32 can include an LED light bar embedded therein, and the second connection member 122*a* supplies electricity to the flexible hook part 32 to emit light. The luminous intensity of the flexible hook part 32 can also respond to the remaining power of the ear-hook earphone with detachable microphone support, for example, a length of a light-emitting part of the LED light bar of the flexible hook part 32 corresponds to the amount of the remaining power. A specific manner of implementation being that certain numbers of LEDs in the LED light bar can be lit according to the amount of the remaining power.

In conclusion, a beneficial effect of the present disclosure is that the present disclosure provides the ear-hook earphone with detachable microphone support, and provides detachable accessories for the earphone, so that users have a flexibility of matching and applying accessories in different scenarios. In addition, the ear hook and the microphone are made completely flexible, allowing users to adjust the ear hook and the microphone according to their ear shape and wearing style to increase firmness and comfort of wearing.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An ear-hook earphone with detachable microphone support, comprising:

an earphone body including a housing assembly, a speaker unit, a first connection member and a second connection member, wherein the housing assembly accommodates the speaker unit, the first connection member and the second connection member;

a microphone support including a plug, and the plug being detachably inserted in the first connection member; and an ear hook including a docking end and a flexible hook part connected to the docking end, and the docking end being detachably inserted in the second connection member;

wherein the flexible hook part includes an LED light bar embedded therein, the second connection member supplies an electricity to the flexible hook part, the LED light bar emits a light, and a luminous intensity of the flexible hook part responds to a remaining power of the ear-hook earphone.

2. The ear-hook earphone according to claim 1, wherein the earphone body includes a speaker section and an assembly section connected to an end of the speaker section, the speaker unit is accommodated in the speaker section, and the assembly section accommodates the first connection member and the second connection member.

3. The ear-hook earphone according to claim 2, wherein the speaker section is disc-shaped, the assembly section is capsule-shaped, a center axis of the speaker section and a center axis of the assembly section are not parallel to each other, and the two center axes form an obtuse angle therebetween.

4. The ear-hook earphone according to claim 2, wherein the speaker section includes a front main casing and a rear main casing connected to the front main casing, a front end of the front main casing is detachably connected to an in-ear eartip, and the in-ear eartip has a tube part and an eartip part, wherein the tube part is detachably connected to the front end of the front main casing, the eartip part is connected to the tube part, and the speaker unit is accommodated in the front main casing and is covered by the rear main casing.

5. The ear-hook earphone according to claim 4, wherein the assembly section includes a main accommodating part and a cover, the main accommodating part is connected to the rear main casing, and the cover is covered on the main accommodating part.

6. The ear-hook earphone according to claim 1, wherein the microphone support further includes a flexible rod body and a microphone, the plug is connected to an end of the flexible rod body, and the microphone is connected to another end of the flexible rod body and is electrically connected to the plug.

7. The ear-hook earphone according to claim 1, wherein the first connection member is an earphone socket.

8. The ear-hook earphone according to claim 1, wherein the second connection member is a fixing hole.

9. The ear-hook earphone according to claim 1, wherein the ear hook has an outer ring, the flexible hook part passes through the outer ring, and a part of the flexible hook part exposed from the outer ring forms a convex part, and wherein the second connection member is disc-shaped and forms a slot inside of the second connection member, the part of the flexible hook part exposed from the outer ring inserts into the second connection member, and the convex part of the flexible hook part is engaged with the slot inside of the second connection member.

10. The ear-hook earphone according to claim 9, wherein the part of the flexible hook part exposed from the outer ring is able to serve as an electrical connection part, an inside of the second connection member serves as another electrical connection part, so that the ear-hook earphone is electrically connected to the flexible hook part through the second connection member.

11. The ear-hook earphone according to claim 1, wherein a length of a light-emitting part of the LED light bar of the flexible hook part corresponds to an amount of the remaining power.

* * * * *